US010362397B2

(12) United States Patent
Lin et al.

(10) Patent No.: US 10,362,397 B2
(45) Date of Patent: Jul. 23, 2019

(54) VOICE ENHANCEMENT METHOD FOR DISTRIBUTED SYSTEM

(71) Applicant: AIROHA TECHNOLOGY CORP., Hsinchu (TW)

(72) Inventors: Heng-Chih Lin, Hsinchu (TW); Wen-Sheng Hou, Hsinchu (TW); Chien-Chen Lin, Hsinchu (TW)

(73) Assignee: Airoha Technology Corp., Hsinchu (TW)

( * ) Notice: Subject to any disclaimer, the term of this patent is extended or adjusted under 35 U.S.C. 154(b) by 0 days.

(21) Appl. No.: 14/960,544

(22) Filed: Dec. 7, 2015

(65) Prior Publication Data

US 2016/0240211 A1 Aug. 18, 2016

(30) Foreign Application Priority Data

Feb. 12, 2015 (TW) ..... 104104715 A

(51) Int. Cl.

| | |
|---|---|
| ***H04R 5/02*** | (2006.01) |
| ***H04R 3/00*** | (2006.01) |
| ***G10L 21/02*** | (2013.01) |
| *H04R 5/027* | (2006.01) |
| *G10L 21/0216* | (2013.01) |
| *G10L 21/0208* | (2013.01) |
| *H04R 1/40* | (2006.01) |

(52) U.S. Cl.

CPC ..... *H04R 5/02* (2013.01); *G10L 21/02* (2013.01); *H04R 3/005* (2013.01); *G10L 21/0208* (2013.01); *G10L 2021/02082* (2013.01); *G10L 2021/02161* (2013.01); *G10L 2021/02166* (2013.01); *H04R 1/406* (2013.01); *H04R 5/027* (2013.01); *H04R 2420/07* (2013.01); *H04R 2430/20* (2013.01)

(58) Field of Classification Search

CPC ..... H04R 5/02; H04R 3/005; H04R 1/406; H04R 5/027; H04R 2420/07; H04R 2430/20; H04R 1/326; G10L 21/02; G10L 21/0208; G10L 2021/02082; G10L 2021/02161; G10L 2021/02166

See application file for complete search history.

(56) References Cited

U.S. PATENT DOCUMENTS

2007/0137462 A1* 6/2007 Barros ..... G10H 1/0058 84/453
2009/0264114 A1* 10/2009 Virolainen ..... H04M 3/56 455/416
2009/0274318 A1* 11/2009 Ishibashi ..... H04M 3/568 381/92
2011/0301730 A1* 12/2011 Kemp ..... G10L 19/008 700/94

(Continued)

FOREIGN PATENT DOCUMENTS

CN 102455421 A 5/2012
CN 103414988 A 11/2013

*Primary Examiner* — Jason R Kurr
(74) *Attorney, Agent, or Firm* — Rosenberg, Klein & Lee

(57) ABSTRACT

A voice enhancement method for distributed system is disclosed. In the method of the present invention, a plurality of picking devices are disposed in a space for picking voice signal. The picking devices communicate with each other and have an enhancement operation on the voice information from each picking device to generate an enhanced voice signal.

8 Claims, 5 Drawing Sheets

(56) References Cited

U.S. PATENT DOCUMENTS

| | | | | |
|---|---|---|---|---|
| 2013/0156198 | A1* | 6/2013 | Kim | H04R 1/323<br>381/17 |
| 2016/0014490 | A1* | 1/2016 | Bar Bracha | H04M 3/56<br>381/92 |

* cited by examiner

VOICE ENHANCEMENT METHOD FOR DISTRIBUTED SYSTEM

FIELD OF THE INVENTION

The present invention is related to a voice enhancement method for distributed system, more particularly to a voice enhancement method for picking devices which communicate with each other.

BACKGROUND OF THE INVENTION

For important meeting or conference, a place with special design or equipment is required. For example, a conference room with sound-absorbing walls or a microphone array with beamforming technology would be appreciated for people to organize an important meeting.

However, it is expensive to build such a conference room and equipment.

In modern word, the division of knowledge is more specialized and professionalized, but the fields of technique included in a project are more and more complicated. Consequently, a plurality of meetings of discussing and organizing for professionals of technical fields are needed to complete a project. The meeting occurs anytime anywhere, but a good conference room is not available anytime.

Consequently, how to provide a voice enhancement method with low cost is the problem of the community.

SUMMARY OF THE PRESENT INVENTION

It is an objective of the present invention to provide a voice enhancement method for distributed system, wherein a plurality of picking devices communicate with each other and have an enhancement operation on voice information.

It is another objective of the present invention to provide a voice enhancement method for distributed system, wherein a plurality of picking devices transmit voice information to each other and have an enhancement operation on the voice information to generate an enhanced voice signal.

The present invention provides a voice enhancement method for distributed system comprising steps of: providing a plurality of picking devices disposed in a space, wherein the plurality of picking devices communicate with each other; using each of the plurality of picking devices to receive a voice signal and generate a voice information corresponding to the received voice signal; using each of the plurality of picking devices to transmit the voice information to each other; and performing an enhancement operation on the voice information and generating an enhanced voice signal.

In one embodiment of the present invention, each of the voice information comprises an intensity and a waveform of the received voice signal, the enhancement operation comprises comparing the intensities of the voice information generated by the picking devices and choosing the waveform with the highest intensity as the enhanced voice signal.

In one embodiment of the present invention, the plurality of picking devices communicate with each other by wired transmission or wireless transmission.

In one embodiment of the present invention, the wireless transmission is selectively one of a Bluetooth transmission, a wireless network transmission, a radio frequency transmission, or an acoustic transmission.

In one embodiment of the present invention, the voice enhancement method further comprises a step of positioning the plurality of picking devices.

In one embodiment of the present invention, the enhancement operation is selectively one of a beamforming operation, a echo cancellation operation, a noise reduction operation, a de-reverberation operation, a gain boost operation or the combination thereof.

In one embodiment of the present invention, the voice enhancement method further comprises a step of providing an operation module for performing the enhancement operation and generating the enhanced voice signal.

In one embodiment of the present invention, the operation module is selectively disposed in one of the plurality of picking devices.

In one embodiment of the present invention, the voice enhancement method further comprises a step of providing a host device, wherein the host device communicates with each of the plurality of picking devices; wherein the operation module is disposed in the host device.

In one embodiment of the present invention, each of the plurality of picking devices has a speaker for playing the enhanced voice signal.

In one embodiment of the present invention, the step of positioning the plurality of picking devices is selectively one of a step of wireless transmission positioning, Bluetooth transmission positioning, wireless network transmission positioning, radio frequency transmission positioning, acoustic transmission positioning, wired transmission positioning, global positioning system positioning, assisted global positioning system positioning or image recognition positioning.

In one embodiment of the present invention, the voice enhancement method further comprises a step of positioning the plurality of picking devices periodically in a predetermined period.

In one embodiment of the present invention, each of the plurality of picking devices is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

The present invention further provides a voice enhancement for distributed system comprising steps of: providing a first picking device and at least one second picking device and disposing the first picking device and the at least one second picking device in a space, wherein the first picking device and the at least one second communicate with each other, wherein the first picking device has an operation module; using each of the first picking device and the at least one second picking device to receive a voice signal and generate a voice information corresponding to the received voice signal; using each of the at least one picking device to transmit the voice information to the first picking device; and using the operation module to perform an enhancement operation on the voice information and generate an enhanced voice signal.

In one embodiment of the present invention, the voice enhancement method further comprises a step of positioning the first picking device and the at least one second picking device.

In one embodiment of the present invention, the enhancement operation is selectively one of a beamforming operation, a echo cancellation operation, a noise reduction operation, a de-reverberation operation, a gain boost operation or the combination thereof.

In one embodiment of the present invention, the voice enhancement method further comprises a step of transmitting the enhanced voice signal to the at least one second picking device; wherein each of the at least one second picking device has a speaker for playing the enhanced voice signal.

In one embodiment of the present invention, the step of positioning the first picking device and the at least one second picking device is selectively one of a step of wireless transmission positioning, Bluetooth transmission positioning, wireless network transmission positioning, radio frequency transmission positioning, acoustic transmission positioning, wired transmission positioning, global positioning system positioning, assisted global positioning system positioning or image recognition positioning.

In one embodiment of the present invention, the voice enhancement method further comprises a step of positioning the first picking device and the at least one second picking device periodically in a predetermined period.

In one embodiment of the present invention, each of the first picking device and the at least one second picking device is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

DETAILED DESCRIPTION OF THE PREFERRED EMBODIMENTS

Figure 1:
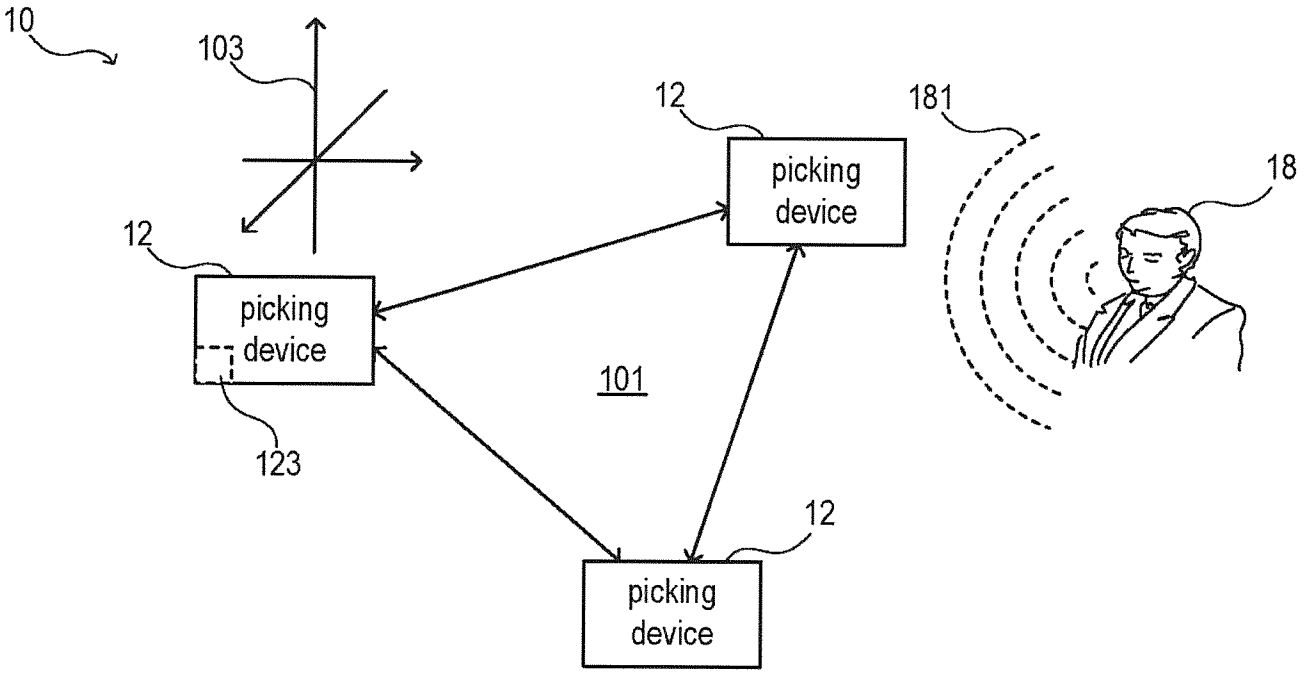
FIG. 1 is a schematic diagram showing a distributed system in accordance with one embodiment of the present invention.
Figure 2:
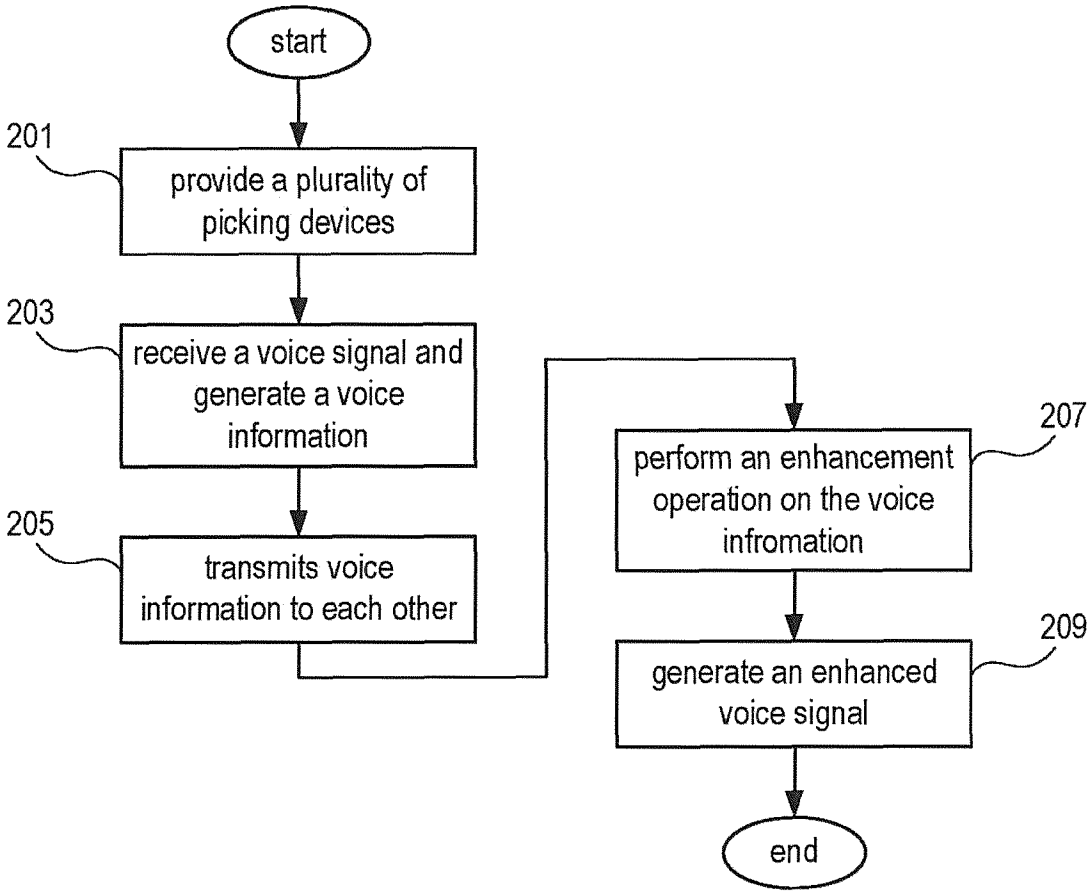
FIG. 2 is a flowchart showing a voice enhancement method for distributed system in accordance with one embodiment of the present invention.

Referring to FIGS. 1 and 2, there are shown a schematic diagram showing the distributed system and the flowchart in accordance with one embodiment of the present invention. The distributed system 10 of the present invention comprises a plurality of picking devices 12 distributed within a space 101, wherein the picking devices communicate with each other. In the voice enhancement method for distributed system of the present invention, a plurality of picking devices 12 of the distributed system 10 are firstly provided in the space 101; each picking device 12 picks up a voice signal 181 generated by a source 18 and generates a voice information corresponding to the received voice signal 181, as shown in steps 201 and 203.

And then, the picking devices 12 transmit generated voice information to each other, as shown in step 205.

Finally, each picking device 12 performs an enhancement operation on the generated voice information and received voice information and generates an enhanced voice signal, as shown in steps 207 and 209.

In one embodiment of the present invention, the voice information generated by the picking device 12 comprises the intensity and the waveform of the voice signal 181. The picking devices 12 transmit the generated voice information to each other and perform an enhancement operation on the generated voice information and the received voice information to generate an enhanced voice signal.

In one embodiment of the present invention, the enhancement operation comprises comparing the intensities of the voice information generated by the picking devices 12 and choosing the waveform with the highest intensity as the enhanced voice signal. The present embodiment is the simplest embodiment of the present invention. It chooses the waveform generated by the picking device 12 which is the closest one to the source 18. Since the picking device 12 is the closest one to the source 18, the received voice signal 181 has the highest intensity and the intensity of the noise is relatively low, choosing the waveform as the enhanced voice signal takes the least resource and operation.

In one embodiment of the present invention, the communications between the picking devices 12 are selectively performed by one of wired transmission or wireless transmission. The wireless transmission is selectively one of a Bluetooth transmission, a wireless network (Wi-Fi) transmission, a radio frequency transmission, or an acoustic transmission.

In one embodiment of the present invention, the voice enhancement method for distributed system further comprises a step of positioning the picking devices 12. Since the picking devices 12 of the present invention communicate with each other, the distances and relative positions between the picking devices 12 can be determined by the communication protocols and the parameters of signal transmission. When the picking devices 12 communicate with each other by wireless transmission, the relative positions of the picking devices 12 can be determined by wireless transmission positioning, for example, Bluetooth transmission positioning, wireless network (Wi-Fi) transmission positioning or radio frequency transmission positioning. When the picking devices 12 communicate with each other by acoustic transmission, the relative positions of the picking devices 12 can be determined by acoustic transmission positioning. When the picking devices 12 communicate with each other by wired transmission, the relative positions of the picking devices 12 can be determined by wired transmission positioning. Furthermore, the positions of the picking devices 12 can also be determined by global positioning system (GPS) positioning, assisted global positioning system (AGPS) positioning or image recognition positioning.

After determining the positions (or relative positions) of the picking devices 12, a coordinate 103 can be constructed in the space 101. When the source 18 generates a voice signal 181, the picking devices 12 receive the voice signal 181 at different locations. Because of the differences of locations and distances, the voice signal 181 received by the picking devices 12 comprise different intensities and phases. By performing a positioning operation on the voice information generated by the picking devices 12, the position of the source 18 in the coordinate 101 can be determined. Furthermore, by performing beamforming operation according to the correlations between the waveforms, the echo cancellation operation, noise reduction operation, de-reverberation operation and gain boost operation for voice enhancement can be achieved.

In one embodiment of the present invention, the voice enhancement method for distributed system further comprises a step of providing an operation module 123 for performing a voice enhancement operation on the voice information and generating an enhanced voice signal. The operation module 123 is selectively disposed in one of the plurality of picking devices 12.

Since most of the electronic devices are able to perform some operations, some simple operations in the present invention can be performed by each picking device 12. For example, the operation of comparing the intensities of the voice information is performed by each picking device 12. In one embodiment of the present invention, an operation module 123 is provided for the operations of positioning the picking devices 12, constructing the coordinate 103 or other complicated enhancement operations. Each picking device 12 transmits information, such as distances between each picking devices 12 and voice information, to the operation module 123 to perform operations.

In one embodiment of the present invention, the operation module 123 can be disposed in a host device (not shown), wherein the host device communicates with the picking devices 12 for receiving information from the picking devices 12.

In one embodiment of the present invention, each picking device 12 comprises a speaker for displaying the enhanced voice signal.

In one embodiment of the present invention, the picking device 12 is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

In one embodiment of the present invention, the voice enhancement method for distributed system further comprises a step of positioning the picking devices 12 periodically in a predetermined period. In one embodiment of the present invention, the picking devices 12 of the distributed system 10 are embodied by the hand-carried electronic devices of the conference participants, such as a mobile phone, a Bluetooth headset, or a notebook computer. When the participants move or the picking devices 12 are moved, the relative positions of the picking devices 12 are changed, and a repositioning operation of the picking devices 12 should be performed for voice enhancement operation.

Figure 3:
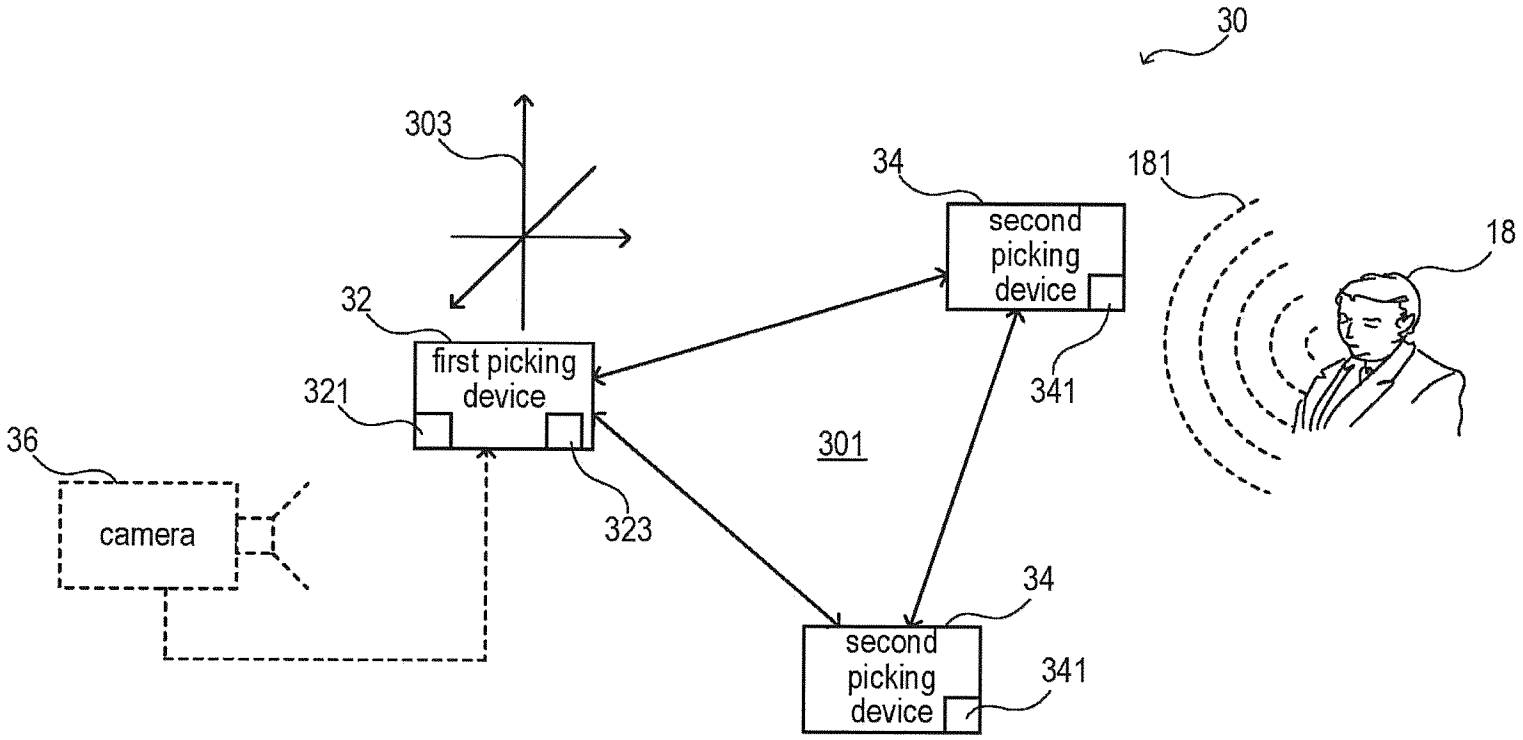
FIG. 3 is a schematic diagram showing a distributed system in accordance with another embodiment of the present invention.
Figure 4:
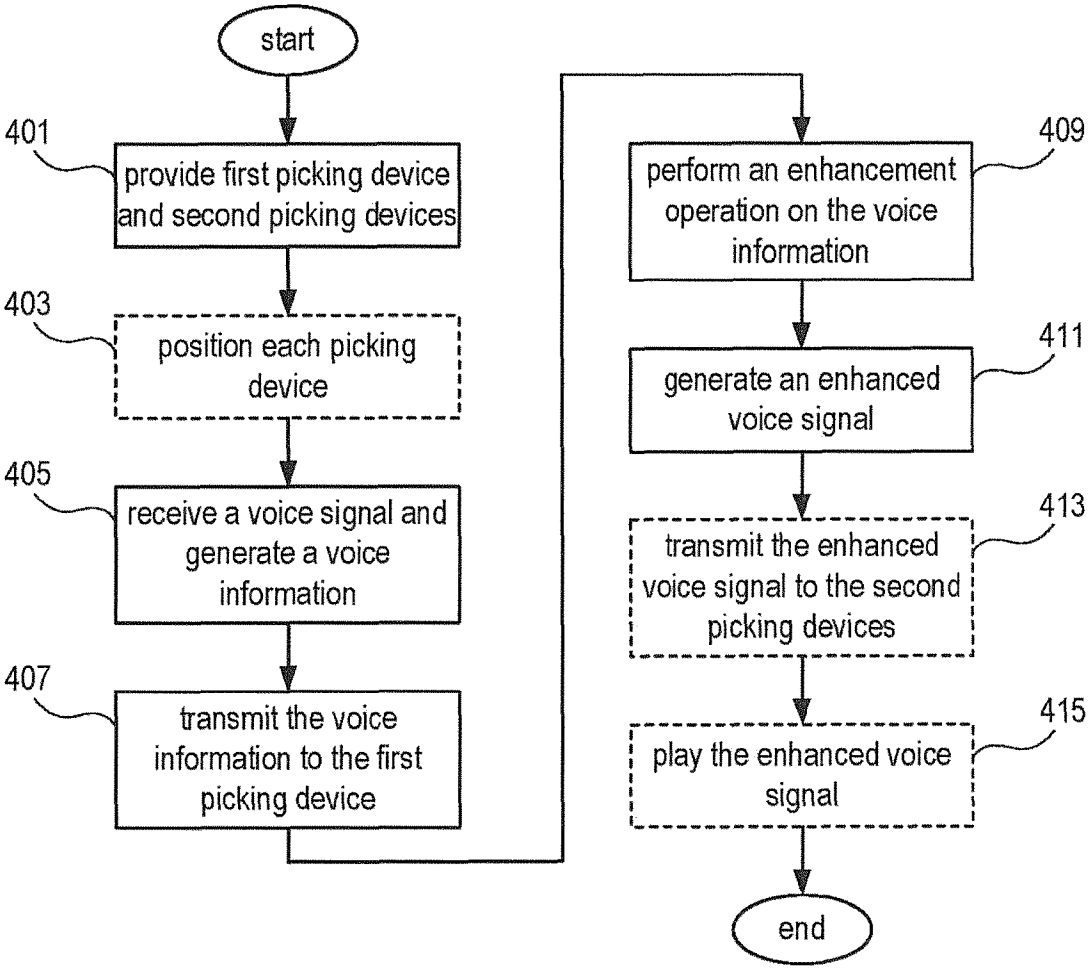
FIG. 4 is a flowchart showing a voice enhancement method for distributed system in accordance with another embodiment of the present invention.

Referring to FIGS. 3 and 4, there are shown a schematic diagram showing the distributed system and the flowchart in accordance with another embodiment of the present invention. The distributed system 30 of the present embodiment comprises a first picking device 32 and at least one second picking device 34. The first picking device 32 and the second picking device 34 are disposed in a space 301. The first picking device 34 and the at least one second picking device 34 communicate with each other. The first picking device 32 comprises an operation module 323.

In the voice enhancement method for distributed system of the present embodiment, a first picking device 32 and at least one second picking device 34 of the distributed system 30 are provided in the space 301; each picking device 32 or 34 picks up a voice signal 181 generated by a source 18 and generates a voice information corresponding to the received voice signal 181, as shown in steps 401 and 405. And then, each second picking device 34 transmits the voice information to the first picking device 32, as shown in step 407. Finally, the operation module 323 of the first picking device 32 performs an enhancement operation on the voice information generated by the first picking device 32 and the second picking device 34 and generates an enhanced voice signal, as shown in steps 409 and 411.

In one embodiment of the present invention, the enhancement operation comprises comparing the intensities of the voice information generated by the first picking device 32 and the second picking device 34 and choosing the waveform with the highest intensity as the enhanced voice signal.

In one embodiment of the present invention, the voice enhancement method for distributed system further comprises a step of positioning the first picking device 32 and the second picking device 34. As described in the aforementioned embodiment, the distance and relative position between the first picking device 32 and the second picking device 34 can be determined by the communication protocols and the parameters of signal transmission. The relative position of the first picking device 32 and the second picking device 34 can be determined by wireless transmission positioning, such as Bluetooth transmission positioning, wireless network (Wi-Fi) transmission positioning, radio frequency transmission positioning, acoustic transmission positioning or wired transmission positioning, according to communication protocol between the first picking device 32 and the second picking device 34. The positions of the first picking device 32 and the second picking device 34 can also be determined by global positioning system (GPS) positioning or assisted global positioning system (AGPS) positioning.

In one embodiment of the present invention, the distributed system 30 of the present invention further comprises a camera 36 connected to or disposed on the first picking device 32 for obtaining the images of the space 301. The images of the space 301 are transmitted to the operation module 323 to perform an image recognition operation for positioning the first picking device 32, the second picking device 34 and the source 18. In the present embodiment, when the position of the source 18, the first picking device 32 or the second picking device 34 is changed, the relative positions of the source 18, the first picking device 32 and the second picking device 34 can be calibrated immediately.

After determining the positions (or relative positions) of the first picking device 32, the second picking device 34, a coordinate 303 is constructed in the space 303. According to the positions of the first picking device 32 and the second picking device 34 in the coordinate 303, the position of the source 18 in the coordinate 303 is determined by the operation module 323 by performing a positioning operation on the voice information generated by the first picking device 32 and the second picking device 34. By performing beamforming operation according to the correlations between the waveforms, the echo cancellation operation, noise reduction operation, de-reverberation operation and gain boost operation for voice enhancement can be achieved.

In one embodiment of the present invention, each of the first picking device 32 and the second picking device 34 comprises a speaker 321 or 341. The voice enhancement method for distributed system further comprises steps of: transmitting the enhanced voice signal to the second picking device 34, and using the speaker 321 and 341 of the first picking device 32 and the second picking device 34 to play the enhanced voice signal, as shown in steps 413 and 415.

In one embodiment of the present invention, the voice enhancement method for distributed system further comprises a step of positioning the first picking device 32 and the second picking device 34 periodically in a predetermined period.

In one embodiment of the present invention, each of the first picking device 32 and the second picking device 34 is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

Figure 5:
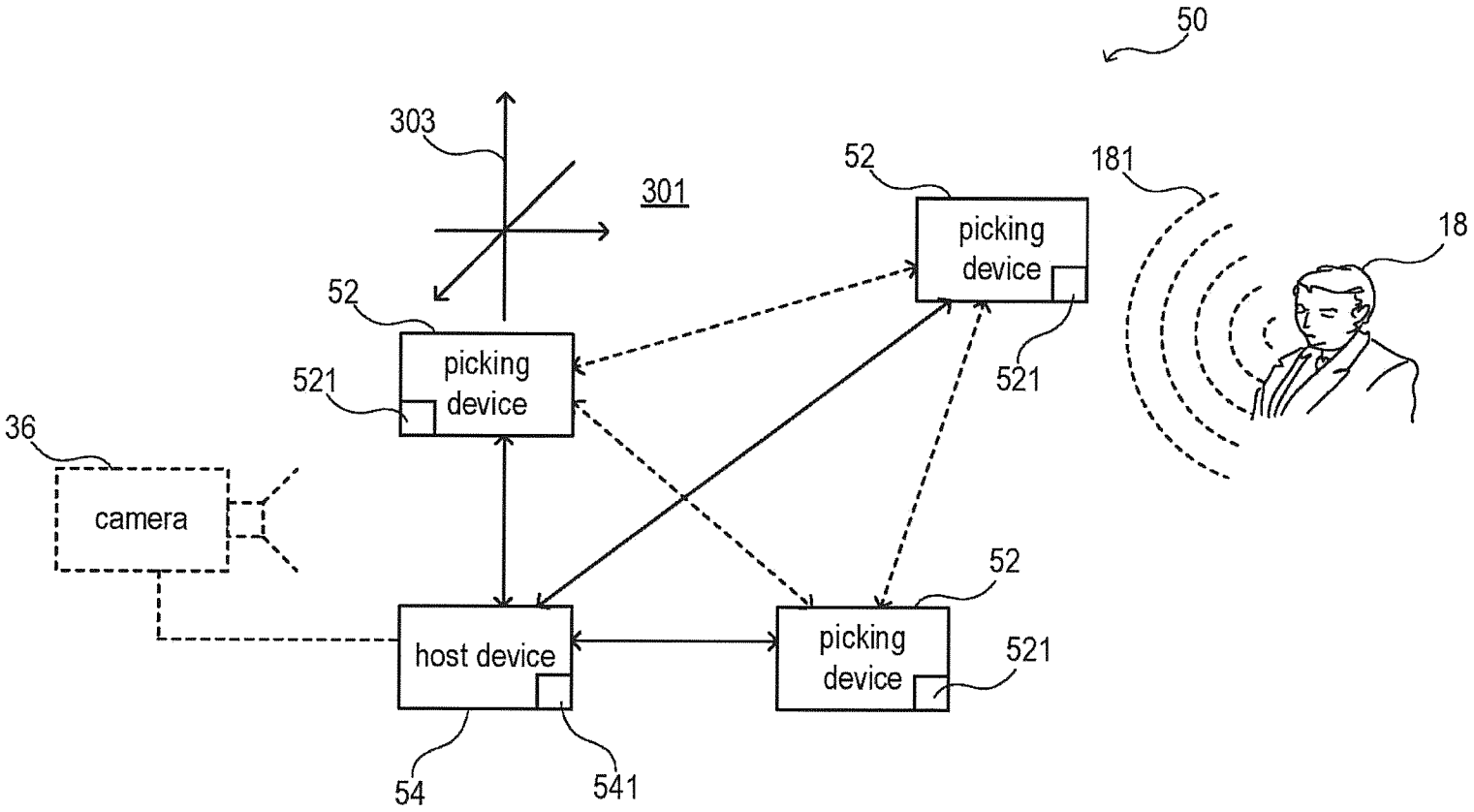
FIG. 5 is a schematic diagram showing a distributed system in accordance with still another embodiment of the present invention.

Referring to FIG. 5, there is shown a distributed system in accordance with still another embodiment of the present invention. The distributed system 50 of the present embodiment comprises a plurality of picking devices 52 and a host device 54. The picking devices 52 and the host device 54 communicate with each other. The host device 54 comprises an operation module 541 for performing operations.

In the present embodiment, since the picking devices 52 communicate with each other, the distances and relative positions between the picking devices 52 can be determined by the communication protocols and the parameters of signal transmission. The voice information generated by the picking devices 52 is transmitted to the host device 54. The operation module 541 performs an enhancement operation on the voice information and generates an enhanced voice signal.

In one embodiment of the present invention, each of the picking devices 52 comprises a speaker 521. The host device 54 transmits the enhanced voice signal to the picking devices 52, and the picking devices 52 play the enhanced voice signal by using the speakers 521.

In one embodiment of the present invention, the distributed system 50 of the present invention further comprises a camera 36 connected to or disposed on the host device 54. The images of the space 301 obtained by the camera 36 are transmitted to the host device 54. The operation module 541 of the host device 54 performs an image recognition operation on the images of the space 301 to determine the positions (or the relative positions) of the picking devices 52 and the source 18. And then, the operations for voice enhancement can be achieved.

Although particular embodiments of the invention have been described in detail for purposes of illustration, various modifications and enhancements may be made without departing from the scope of the invention specified by the claims.

What is claimed is:

1. A voice enhancement method for a distributed system comprising:

providing a first picking device and at least one second picking device;

disposing the first picking device and the at least one second picking device in a common auditory space with a source of voice signals, wherein the first picking device and the at least one second picking device communicate with each other and the first picking device has an operation module;

providing video images of the common auditory space from a camera to the operation module;

positioning the first picking device, the at least one second picking device and the source of voice signals relative to one another using the video images by image recognition positioning, the positioning of the first picking device, the at least one second picking device, and the source of voice signals being updated responsive to a change in position of any of the first picking device, the at least one second picking device and the source of voice signals using the video images;

actuating each of the first picking device and the at least one second picking device to receive the voice signals from the source of voice signals and generate voice information corresponding to the received voice signals;

actuating each second picking device to transmit the voice information generated thereby to the first picking device;

actuating the operation module to perform an enhancement operation on the voice information of the first and second picking devices and generate an enhanced voice signal therefrom;

transmitting the enhanced voice signal from the first picking device to the at least one second picking device to be played thereat, whereby the at least one second picking device is enhanced in voice signal playback quality.

2. The voice enhancement method as claimed in claim 1, wherein the enhancement operation is selectively one of a beamforming operation, an echo cancellation operation, a noise reduction operation, a de-reverberation operation, a gain boost operation or the combination thereof.

3. The voice enhancement method as claimed in claim 1, wherein each of the at least one second picking devices has a speaker for playing the enhanced voice signal.

4. The voice enhancement method as claimed in claim 1, wherein each of the first picking device and the at least one second picking device is selectively one of a speakerphone, a wired telephone, a wireless telephone, a mobile phone, a Bluetooth headset, a wired microphone, a wireless microphone, a wired speaker with microphone, a wireless speaker with microphone or a notebook computer.

5. The voice enhancement method as claimed in claim 1, wherein the voice information generated by each of the plurality of picking devices includes waveforms of the received voice signals, the enhancement operation including:

determining relative distances between the first picking device and the at least one second picking device and the source of voice signals, and choosing the waveforms generated by a picking device closest to the source of voice signals as the enhanced voice signal.

6. A voice enhancement method for a distributed system comprising:

providing a plurality of picking devices disposed within a common auditory space with a source of a voice signals, wherein the plurality of picking devices communicate with each other;

providing video images of the common auditory space;

positioning the plurality of picking devices and the source of the voice signals relative to one another using the video images using image recognition positioning, the positioning of the plurality of picking devices and the source of the voice signal being updated responsive to a change in position any of the plurality of picking devices or the source of the voice signal using the video images;

actuating each of the plurality of picking devices to receive the voice signals from the source of voice signals and generate voice information corresponding to the received voice signals;

actuating the plurality of picking devices to transmit the voice information generated thereby to each of the other of the plurality of picking devices;

performing an enhancement operation at a selected one of the plurality of picking devices on the voice information of all of the plurality of the picking devices and generating an enhanced voice signal; and transmitting the enhanced voice signal from the selected one of the plurality of picking devices to at least one other of the plurality of picking devices within the common auditory space to be played thereat, whereby the at least one other of the plurality of picking devices is enhanced in voice signal playback quality.

7. The voice enhancement method as claimed in claim 6, wherein providing video images of the common auditory space includes providing a camera coupled to the selected one of the plurality of picking devices and providing the video images thereto.

8. The voice enhancement method as claimed in claim 7, further comprising providing an operation module in the selected one of the plurality of picking devices for performing image recognition positioning, the enhancement operation and generation of the enhanced voice signal.

* * * * *